US012320056B2

(12) United States Patent
Pieretti et al.

(10) Patent No.: US 12,320,056 B2
(45) **Date of Patent: *Jun. 3, 2025**

(54) BULK DISPENSER FOR A LAUNDRY TREATING APPLIANCE

(71) Applicant: WHIRLPOOL CORPORATION, Benton Harbor, MI (US)

(72) Inventors: Fernanda K. Pieretti, Rio Claro (BR); Bruno T. Ramasco, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/392,630

(22) Filed: Dec. 21, 2023

(65) Prior Publication Data

US 2024/0125035 A1 Apr. 18, 2024

Related U.S. Application Data

(60) Continuation of application No. 17/985,529, filed on Nov. 11, 2022, now abandoned, which is a continuation of application No. 16/926,816, filed on Jul. 13, 2020, now Pat. No. 11,519,123, which is a division of application No. 15/958,090, filed on Apr. 20, 2018, now Pat. No. 10,731,285.

(60) Provisional application No. 62/520,146, filed on Jun. 15, 2017.

(51) Int. Cl.
*D06F 39/02* (2006.01)
*D06F 23/04* (2006.01)

(52) U.S. Cl.
CPC ..... *D06F 39/02* (2013.01); *D06F 39/024* (2013.01); *D06F 23/04* (2013.01)

(58) Field of Classification Search
CPC ..... B67D 1/1444; F16K 3/085; Y10T 137/86743; B65D 83/0011; B65D 83/0016; B65D 88/68; A47K 5/10; B65B 37/10
See application file for complete search history.

(56) References Cited

U.S. PATENT DOCUMENTS

| | | | |
|---|---|---|---|
| 2,979,935 | A | 4/1961 | Oles |
| 3,724,242 | A | 4/1973 | Davis |
| 5,899,248 | A | 5/1999 | Anderson |
| 6,301,734 | B1 | 10/2001 | Dunsbergen |
| 11,519,123 | B2 | 12/2022 | Pieretti et al. |
| 2004/0107743 | A1 | 6/2004 | Kim et al. |

(Continued)

FOREIGN PATENT DOCUMENTS

| | | | |
|---|---|---|---|
| DE | 2646882 | A1 | 4/1977 |
| EP | 1236430 | A2 | 9/2002 |
| GB | 589374 | A | 6/1947 |

OTHER PUBLICATIONS

DE2646882—Machine Translation (Year: 1977).

*Primary Examiner* — Marc Lorenzi
(74) *Attorney, Agent, or Firm* — McGarry Bair PC

(57) ABSTRACT

A laundry treating appliance includes a treating chamber, an agitator rotatably mounted in the treating chamber and having a skirt and a hollow shaft extending upwardly from the skirt, and a bulk dispenser located within the hollow shaft. The bulk dispenser includes a tubular tank with a rotatable actuator on one end, a dispenser on the other end, and a shaft passing through the tubular tank and connecting the rotatable actuator to the dispenser. A plurality of projections extend from the shaft for moving a treating chemistry through the hollow shaft.

13 Claims, 9 Drawing Sheets

(56) References Cited

U.S. PATENT DOCUMENTS

| | | | |
|---|---|---|---|
| 2005/0045652 | A1 | 3/2005 | Maser |
| 2007/0062564 | A1 | 3/2007 | Farano |
| 2010/0006123 | A1 | 1/2010 | Simpson et al. |

BULK DISPENSER FOR A LAUNDRY TREATING APPLIANCE

CROSS REFERENCE TO RELATION APPLICATIONS

This application is a continuation application of U.S. patent application Ser. No. 17/985,529, now abandoned, filed Nov. 11, 2022, which is a continuation application of U.S. patent application Ser. No. 16/926,816, filed Jul. 13, 2020, issued as U.S. Pat. No. 11,519,123 on Dec. 6, 2022, which is a divisional application of U.S. patent application Ser. No. 15/958,090, filed Apr. 20, 2018, issued as U.S. Pat. No. 10,731,285 on Aug. 4, 2020, which claims the benefit of U.S. Provisional Application No. 62/520,146, filed Jun. 15, 2017, all of which are incorporated herein by reference in their entirety.

BACKGROUND

Laundry treating appliances, such as clothes washers, clothes dryers, refreshers, and non-aqueous systems, can have a configuration based on a rotating drum that defines a treating chamber having an access opening through which laundry items are placed in the treating chamber for treating. The laundry treating appliance can have a controller that implements a number of pre-programmed cycles of operation having one or more operating parameters.

In some laundry treating appliances, a user supplies the laundry treating appliance with a treating chemistry prior to or during each cycle of operation. The treating chemistry may be added directly to the treating chamber or added to a dispenser that supplies the treating chemistry to the treating chamber at the appropriate time in the cycle of operation. It can be desirable to provide a bulk dispenser that is capable of storing multiple doses of a treating chemistry so that a user does not have to handle the treating chemistry each time a cycle of operation is implemented.

SUMMARY

One aspect of the disclosure is a laundry treating appliance that has a treating chamber, an agitator rotatably mounted in the treating chamber and having a skirt and a hollow shaft extending upwardly from the skirt, and a bulk dispenser located within the hollow shaft comprising a tubular tank with a rotatable actuator on a first end, a dispenser assembly on a second end, and a shaft passing through the tubular tank and connecting the rotatable actuator to the dispenser assembly. The dispenser assembly comprising first and second dispenser plates positioned on the second end of the tubular tank, one of the first and second plates comprising at least one opening and at least one seal, the other of the first and second plates comprising an outlet having a shape complimentary to the at least one seal, the at least one seal comprising a raised portion that is configured to be received in the outlet on the other of the first and second plates, and a plurality of projections extending from the shaft for moving a treating chemistry through the hollow shaft. Wherein rotating of the actuator effects a rotation of the plurality of projections, which effects dispensing a predetermined amount of the treating chemistry from the outlet.

Another aspect is a laundry treating appliance that has a treating chamber, an agitator rotatably mounted in the treating chamber and a skirt that has a hollow shaft extending upwardly from the skirt. A bulk dispenser is located within the hollow shaft comprising a tubular tank with a rotatable actuator on a first end, a dispenser assembly on a second end comprising an outlet, and a shaft passing through the tubular tank and connecting the rotatable actuator to the dispenser assembly. A plurality of projections extending orthogonally from the shaft and engaging an interior surface of the tubular tank for dislodging treating chemistry adhered to the interior surface of the tubular tank. Rotating of the actuator effects a rotation of the plurality of projections, which effects dispensing a predetermined amount of the treating chemistry from the outlet.

DESCRIPTION

Figure 1:
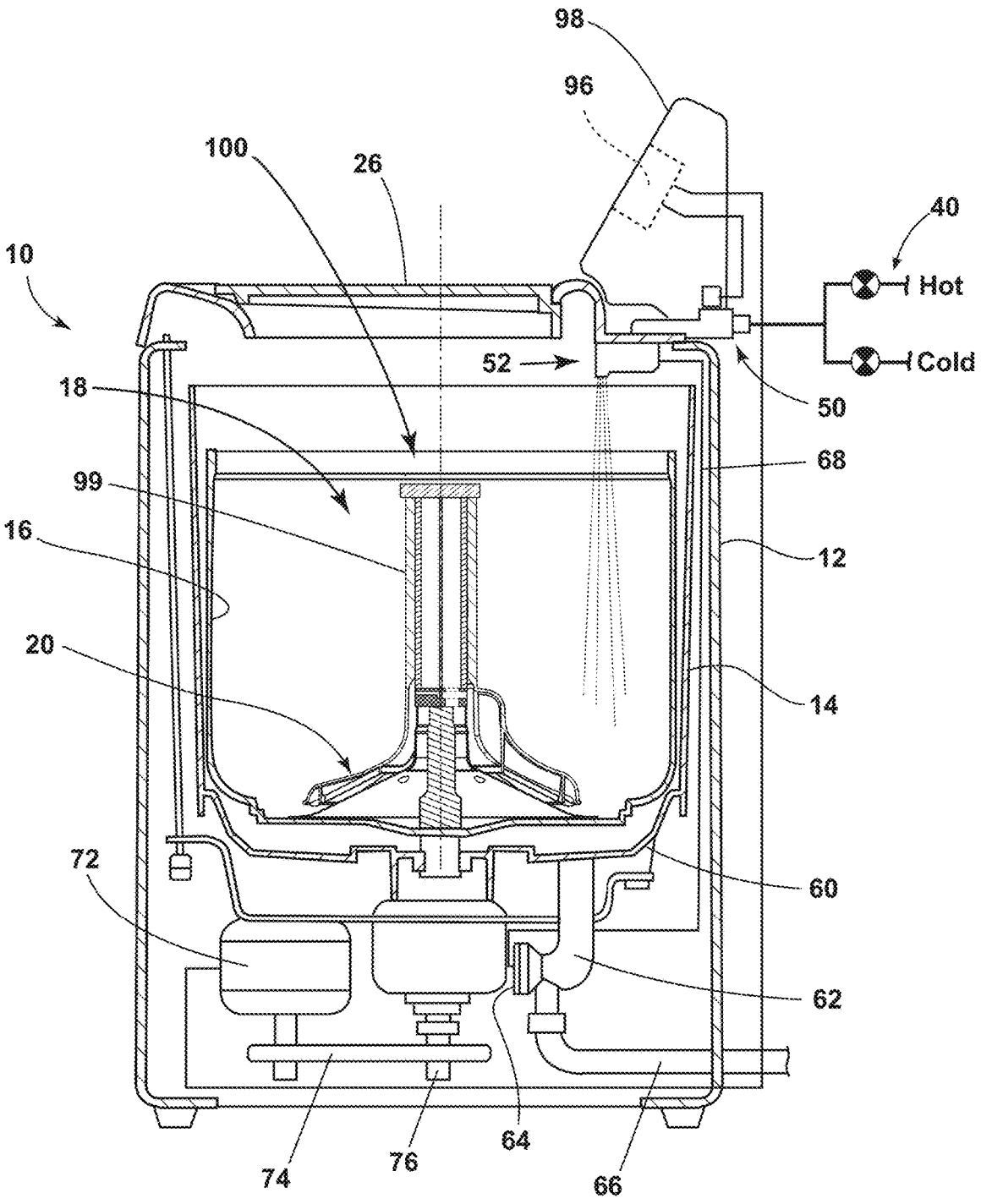
FIG. 1 is a schematic view of a laundry treating appliance in the form of a washing machine according to the present disclosure.

FIG. 1 is a schematic view of a laundry treating appliance according to a first embodiment. The laundry treating appliance may be any appliance which performs a cycle of operation to clean or otherwise treat items placed therein, non-limiting examples of which include a horizontal or vertical axis clothes washer or washing machine; a combination washing machine and dryer; a tumbling or stationary refreshing/revitalizing machine; an extractor; a non-aqueous washing apparatus; and a revitalizing machine.

As used herein, the term "vertical axis" washing machine refers to a washing machine having a rotatable drum that rotates about a generally vertical axis relative to a surface that supports the washing machine. However, the rotational axis need not be perfectly vertical to the surface. The drum may rotate about an axis inclined relative to the vertical axis, with fifteen degrees of inclination being one example of the inclination Similar to the vertical axis washing machine, the term "horizontal axis" washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination.

FIG. 1 is a schematic view of a laundry treating appliance in the form of a vertical axis washing machine. While the embodiments of the invention are described in the context of a vertical axis washing machine, it will be understood that the embodiments may be used with a horizontal axis washing machine in a similar manner Still referring to FIG. 1, the laundry treating appliance is illustrated as a washing machine 10, which may include a structural support system comprising a cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system comprises a tub 14 supported within the cabinet 12 by a suitable suspension system and a drum 16 provided within the tub 14, the drum 16 defining at least a portion of a laundry treating chamber 18. The drum 16 may include a plurality of perforations (not shown) such that liquid may flow between the tub 14 and the drum 16 through the perforations. It is also within the scope of the invention for the laundry holding system to comprise only a tub with the tub defining the laundry treating chamber. A rotatable clothes mover 20 may be provided within the treating chamber 18 for imparting mechanical energy to the laundry items during a cycle of operation. The clothes mover 20 may be an agitator, impeller, nutator, or the like for imparting mechanical energy to the laundry items. The laundry holding system may further include a door 26 which may be movably mounted relative to the cabinet 12 to selectively close both the tub 14 and the drum 16.

The washing machine 10 may further include a liquid supply system for supplying water to the washing machine 10 for use in treating laundry during a cycle of operation. The liquid supply system may be fluidly coupled to a source of water, such as a household water supply 40 for controlling the flow of water to a water supply circuit 50 for distribution to one or more components of the washing machine 10. The water supply circuit 50 may be coupled with a water nozzle 52 for supplying water from the household water supply 40 to the tub 14 and/or drum 16. In the example illustrated in FIG. 1, the water nozzle 52 is configured to supply water into the drum 16. In another example, the water nozzle 52 may be configured to supply water directly into the tub 14. The water nozzle 52 may be configured to dispense the treating chemistry into the tub 14 or drum 16 in a desired pattern and under a desired amount of pressure, the details of which are not germane to the present disclosure.

The washing machine 10 may optionally include a recirculation and drain system for recirculating liquid within the laundry holding system and draining liquid from the washing machine 10. Liquid supplied to treating chamber 18 typically enters a space between the tub 14 and the drum 16 and may flow by gravity to a sump 60 formed in part by a lower portion of the tub 14. The sump 60 may also be formed by a sump conduit 62 that may fluidly couple the lower portion of the tub 14 to a pump 64. The pump 64 may direct liquid to a drain conduit 66, which may drain the liquid from the washing machine 10, or to a recirculation conduit 68, which may direct the liquid from the sump 60 into the drum 16. The recirculation conduit 68 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more devices for heating laundry and/or liquid supplied to the tub 14, the details of which are not germane to the present description. Non-limiting examples of heating systems include a steam generator and a sump heater. Additionally, the liquid supply, recirculation, drain systems may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 72, which may be directly coupled with the drum 16 through a belt 74 and a drive shaft 76 to rotate the drum 16, as is known in the art. Alternatively, the motor may be a brushless permanent magnet (BPM) motor, an induction motor, or a permanent split capacitor (PSC) motor. The motor 72 may rotate the drum 16 at various speeds in either rotational direction.

The washing machine 10 also includes a control system for controlling the operation of the washing machine 10 to implement one or more cycles of operation. The control system may include a controller 96 located within the cabinet 12 (optionally exterior of the cabinet 12) and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

The controller 96 may be provided with a memory and a central processing unit (CPU). The memory may be used for storing the control software that is executed by the CPU in completing a cycle of operation using the washing machine 10 and any additional software. Examples, without limitation, of cycles of operation include: wash, heavy duty wash, delicate wash, quick wash, pre-wash, refresh, rinse only, and timed wash. The memory may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 72, the pump 64, bulk dispenser 100, a steam generator, and a sump heater to control the operation of these and other components to implement one or more of the cycles of operation.

The controller 96 may also be coupled with one or more sensors provided in one or more of the systems of the washing machine 10 to receive input from the sensors, which are known in the art and not shown for simplicity. Non-limiting examples of sensors that may be communicably coupled with the controller 96 include: a treating chamber temperature sensor, a moisture sensor, a weight sensor, a chemical sensor, a position sensor and a motor torque sensor, which may be used to determine a variety of system and laundry characteristics, such as laundry load inertia or mass.

Still referring to FIG. 1, the washing machine 10 may include a bulk dispenser 100 that is supported by the clothes mover 20. The bulk dispenser 100 is configured to fit within a hollow column 99 of the clothes mover 20 for dispensing a treating chemistry into the treating chamber 18. The bulk dispenser 100 may be supported within the hollow column 99 using any suitable mechanical or non-mechanical fasteners, non-limiting examples of which include brackets, clamps, screws, adhesives, and welds. In one example, the bulk dispenser 100 may be supported within the hollow column 99 by an interference fit between the bulk dispenser and the hollow column 99. In another example, the bulk dispenser 100 may be supported at a top and/or bottom end by a flange extending from the hollow column 99.

While the bulk dispenser 100 is described in the context of being removable from the hollow column 99 of the clothes mover 20, the bulk dispenser 100 may optionally be configured to remain within the hollow column 99 or be integrally formed with the hollow column 99 such that the hollow column 99 forms at least a portion of the bulk dispenser 100. The bulk dispenser 100 is configured to allow a user to dispense a predetermined amount of treating chemistry into the treating chamber 18 by actuating the bulk dispenser 100 either manually or through an automatic actuation device.

Non-limiting examples of treating chemistries that may be dispensed by the bulk dispenser 100 during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof. The treating chemistry may be in any suitable form, non-limiting examples of which include a powder, a liquid, a gel, granules, and combinations thereof.

Figure 2A:
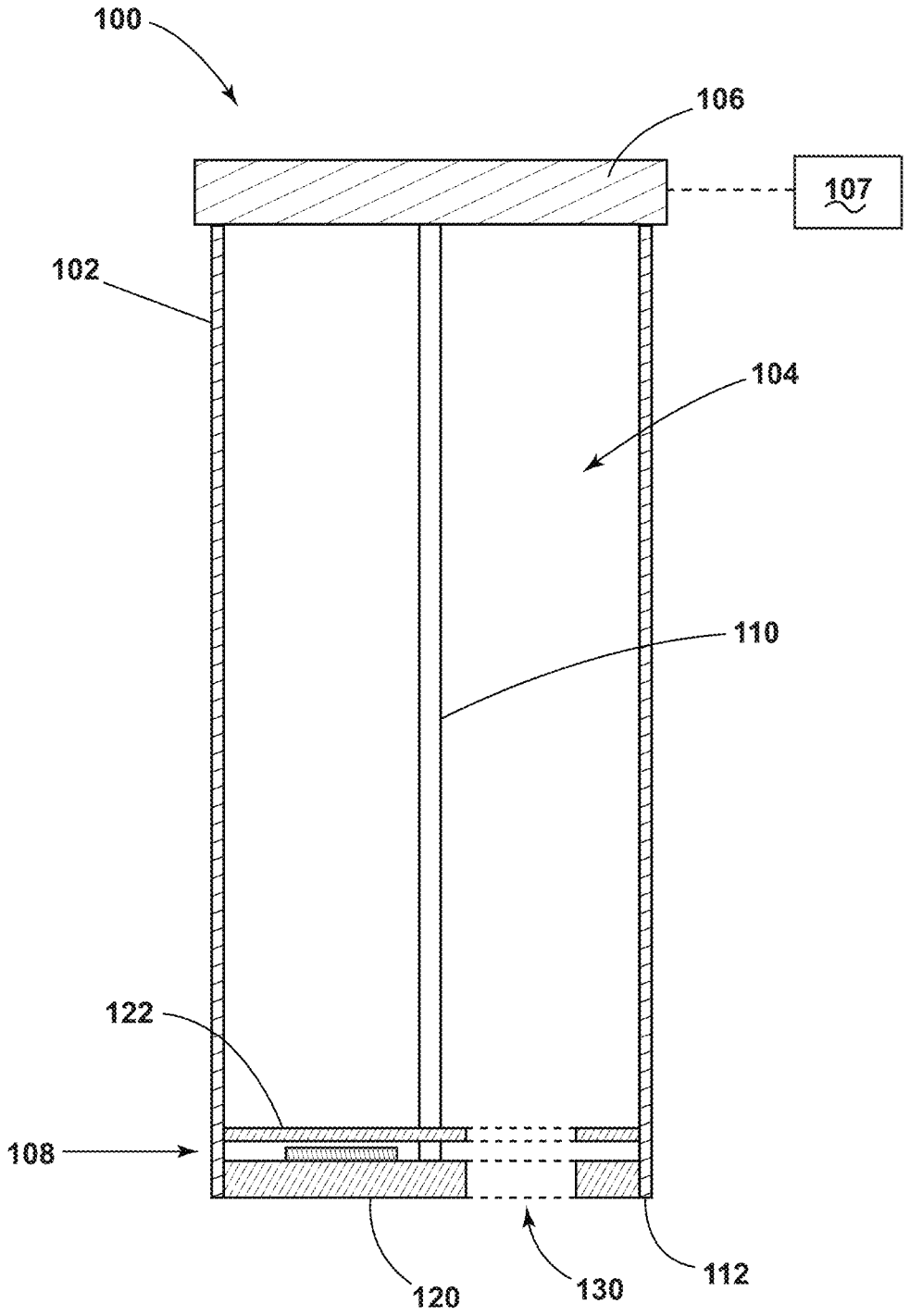
FIG. 2A is a schematic cross-sectional view of a bulk dispenser for use in the laundry treating appliance of FIG. 1 according to the present disclosure.

Referring now to FIG. 2A, the bulk dispenser 100 includes a container body 102 defining a reservoir 104 for holding a treating chemistry. An actuator 106 is disposed at a first end of the container body 102 and is operably connected to a dispenser assembly 108 for operation of the dispenser assembly 108 to selectively dispense a treating chemistry from the reservoir 104. In the example of FIG. 2A, the actuator 106 is in the form of a lid that is connected to the dispenser assembly 108 by an actuating member 110. The bulk dispenser 100 is configured such that at least a portion of the container body 102 is received within the hollow column 99 of the clothes mover 20 and the actuator 106 remains accessible for operation by a user. Optionally, the bulk dispenser 100 can be configured to rest on top of or fit over the clothes mover 20 or be mounted to an exterior surface of the column 99.

In the exemplary embodiment shown, it is contemplated that a user can physically or manually turn the actuator 106 to dispense treating chemistry. Alternatively, the bulk dispenser 100 could be configured with a separate pump or motor 107 configured turn or drive the actuator 106. The motor 107 could be positioned at or near either the top or bottom of the bulk dispenser 100 for automatically turning the actuator 106 before or during washing operation. If located near the top of the bulk dispenser 100, the motor would be not be submersed in wash liquid while in operation and could be configured to turn the actuator 106 with a rotatable collar or other mechanical linkage. If located near the bottom of the bulk dispenser 100, the electrical motor 107 could be sealed so it could be submersed in wash liquid. In either case, the motor 107 could be operable coupled to the controller 96 through a wired or wireless coupling for allowing the controller 96 to control the motor 107 and thus, control the operation of the bulk dispenser 100. In addition, the motor 107 could be powered by direct hard wiring, battery, or rechargeable battery. In one embodiment, if the motor 107 is located near the clothes mover 20, the motor 107 could be charged or re-charged by using the kinetic energy of the clothes mover during operation. Alternatively, rechargeable batteries could be charged wirelessly or through a docking station.

The dispenser assembly 108 is disposed adjacent an open bottom end 112 of the container body 102 for selectively dispensing a treating chemistry from the reservoir 104 into the treating chamber 18. The dispenser assembly 108 can include a plurality of dispensing plates 120, 122 that are operable to define a dispensing outlet 130 through which the treating chemistry may be dispensed from the reservoir 104 during a dispensing operation.

Figure 3:
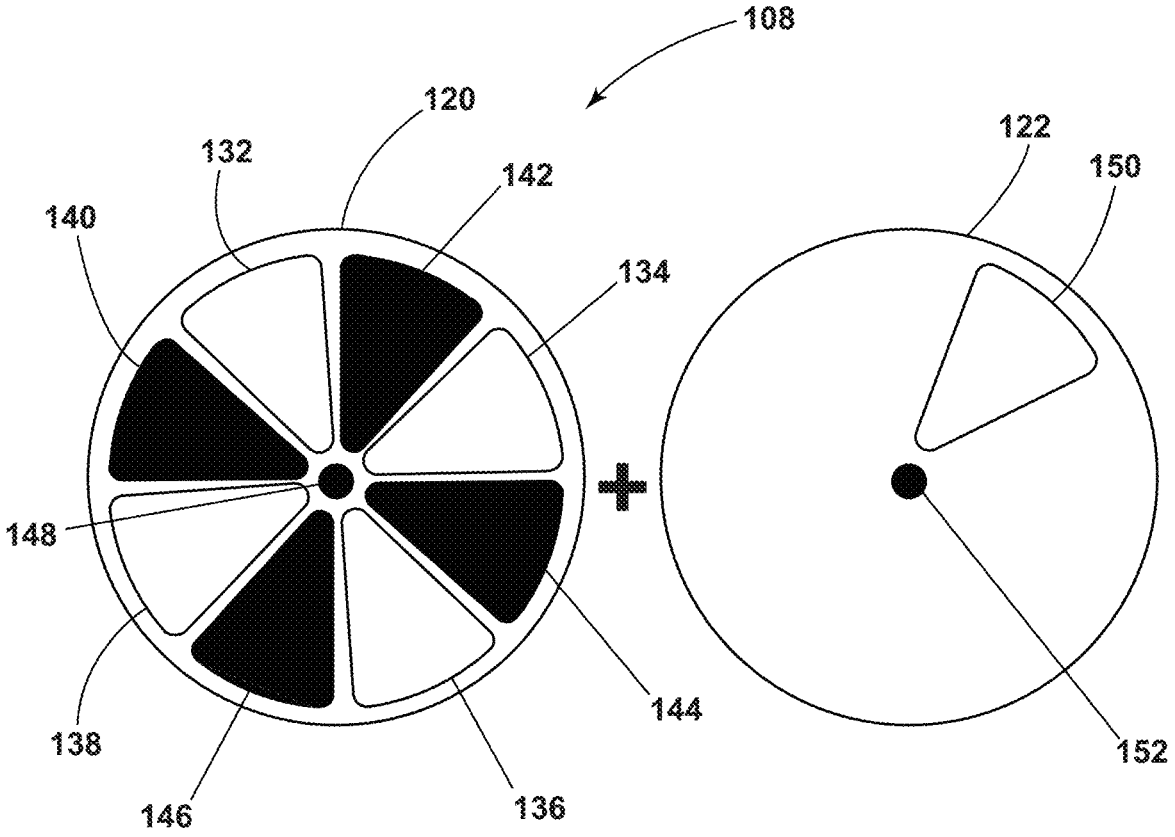
FIG. 3 is a top down view of a dispensing assembly for use in the bulk dispenser of FIG. 2A according to the present disclosure.

As illustrated in FIG. 3, the dispenser assembly 108 can include a first plate 120 and a second plate 122 that cooperate to selectively dispense a predetermined amount of treating chemistry from the reservoir 104 through the dispensing outlet 130 during operation of the actuator 106. The first plate 120 can include a plurality of openings 132-138 spaced around the first plate 120. The openings 132-138 may be the same or different size and may be evenly or unevenly spaced around the first plate 120 based on the amount of treating chemistry to be dispensed. Optionally, portions of the first plate 120 between the openings 132-138 include a plurality of seals 140-146. In another aspect, the first plate 120 may have a surface including a sealing material that forms the seals 140-146. The first plate 120 is coupled to the actuating member 110 at a central axis 148 thereof for co-rotation about the central axis 148 when the actuator 106 is rotated. Alternatively, the second plate 122 may be coupled to the actuating member 110 for co-rotation when the actuator 106 is rotated.

The second plate 122 includes an outlet 150 that is configured to cooperate with the openings 132-138 in the first plate 120 to define the dispensing outlet 130 (FIG. 2A) for dispensing the treating chemistry. The second plate 122 is mounted within the container body 102 such that the second plate 122 does not move relative to the first plate 120. The second plate 122 can include a central aperture 152 through which the actuating member 110 passes. The dimensions of the seals 140-146 and the outlet 150 can be configured such that the seals 140-146 mate with the outlet 150 when aligned to provide a liquid-tight seal between the first and second plates 120, 122.

Optionally, the first plate 120 is under tension and is biased toward the second plate 122 by a spring or other biasing member. The first plate 120 may be supported relative to the second plate 122 such that the first plate 120 has a predetermined degree of freedom to couple when rotated such that the seal 140-146 is sealed with outlet 150 and to decouple such that one of the openings 132-138 is aligned with the outlet 150.

The seals 140-146 can include a raised portion (visible in FIG. 2A) projecting above a surface of the first plate 120 that is configured to be at least partially received within the outlet 150 for forming the light-tight seal. The seals 140-146 may be made from any suitable rubber or polymeric material for forming the liquid-tight seal with the outlet 150. The embodiments illustrated in FIGS. 2 and 3 includes the first plate 120 disposed below the second plate 122 such that the seals 140-146 project upward to engage the outlet 150. Alternatively, the first plate 120 can be disposed above the second plate 122 and the seals 140-146 can be configured to project downward toward the second plate 122 to engage the outlet 150 to form the liquid-tight seals.

The seals 140-146 can form a liquid-tight seal with the outlet 150 to minimize or inhibit moisture from entering the reservoir 104. Moisture in the reservoir 104 may interact with the treating chemistry stored therein, causing undesirable aggregation and/or degradation of the treating chemistry. Aggregation of the treating chemistry can generate clumps that may clog the dispensing outlet 130 or interfere with operation of the actuator 106 and actuating member 110. Additional seals may optionally be provided to inhibit moisture from entering the reservoir 104, such as between the actuating member 110 and the second plate 122 and between the actuator 106 and the container body 102.

In operation, a user can rotate or the controller 96 can be programmed to rotate the actuator 106 before or during the washing operation. Rotating the actuator 106 causes the first plate 120 to rotate relative to the second plate 122 to selectively dispense treating chemistry stored in the reservoir 104 to the treating chamber 18. The dimensions, spacing, and position of the openings 132-138 in the first plate 120 and the outlet 150 in the second plate 122 are configured to dispense a predetermined amount of treating chemistry based on the operation of the actuator 106. When the first plate 120 is rotated such that an opening 132-138 is aligned with the outlet 150 in the second plate 122, the dispensing outlet 130 is opened and treating chemistry is dispensed from the reservoir 104 through the dispensing outlet 130.

Each time the dispensing outlet 130 is opened by the alignment of one of the openings 132-138 with the outlet 150, a unit dose is dispensed. The amount of treating chemistry dispensed in each unit dose may be based on one or more parameters, non-limiting examples of which include the dimensions of the openings 132-138 and the outlet 150, the amount of time during which the openings 132-138 and outlet 150 are aligned, the viscosity of the treating chemistry, and the flow rate of the treating chemistry through the dispensing outlet 130.

The number of unit doses dispensed is based at least in part on the number of openings 132-138 that align with the outlet 150 during operation of the actuator 106, which is based on the degree to which the actuator 106 is rotated from an initial position. As the actuator 106 is rotated, the number of unit doses dispensed increases. The number of unit doses dispensed may be based on one or more characteristics of the laundry and/or the treating chemistry, non-limiting examples of which include an amount of laundry being treated, a type of laundry being treated, a soil level of the laundry being treated, the cycle of operation to be implemented, an amount of water supplied during treatment, a type of treating chemistry being dispensed, and a concentration of the treating chemistry being dispensed.

In one example, the unit dose may be based on an amount of treating chemistry suitable for treating a small laundry load and multiple unit doses may be dispensed for load sizes greater than a small load, such as medium, large, and extra-large load sizes. While the amount of laundry is described qualitatively as encompassing small, medium, and large load sizes, etc., the amount of laundry may be described qualitatively or quantitatively according to any desired number of increments. In another example, the unit dose may be based on the cycle of operation to be implemented or an amount of water to be supplied during treatment.

Still referring to FIG. 3, when the first and second plates 120 and 122 are in the position illustrated in FIG. 3, the seal 142 is aligned with the outlet 150 such that the dispensing outlet 130 is closed. A clock-wise quarter turn of the actuator 106 (FIG. 2A) causes the first plate 120 to rotate a quarter turn clockwise relative to the second plate 122. As the first plate 120 is rotated, the opening 132 comes into alignment with the outlet 150 such that the dispensing outlet 130 is opening. As the quarter turn is completed, the first plate 120 comes to rest with the seal 140 aligned with the outlet 150 such that the dispensing outlet 130 is again closed. When the actuator 106 is rotated a ⅛ turn, the opening 132 is aligned with the outlet 150 and dispensing continues until the actuator 106 is rotated another ⅛ turn to close the outlet 150.

The amount of treating chemistry dispensed can vary depending on the speed at which the actuator 106 is rotated and thus the size of a "single" dose may vary during each use. Thus, a single unit dose may be considered as a corresponding to a range of amounts of treating chemistry based on a range of typical speeds of rotation of the actuator 106. In another aspect, the first plate 120 may be configured to rotate at a predetermine rate or a predetermined increment (e.g. multiples of a quarter turn) when the actuator 106 is rotated. A single unit dose of treating chemistry is dispensed while the opening 132 is in alignment with the outlet 150 and dispensing ends when the opening 132 is moved out of alignment.

Figure 2B:
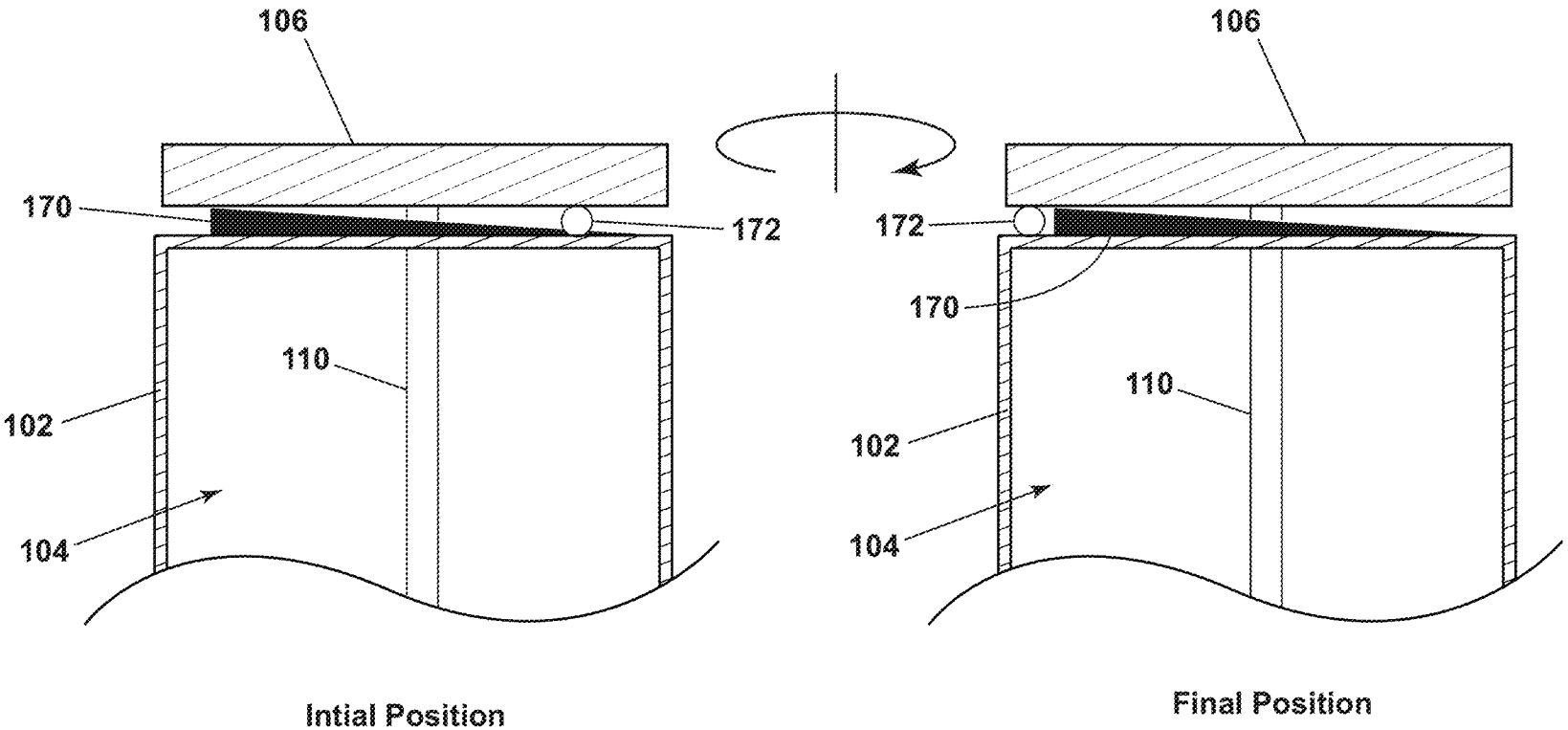
FIG. 2B is a schematic cross-sectional view of a portion of a bulk dispenser for use in the laundry treating appliance of FIG. 1 according to the present disclosure.

FIG. 2B illustrates an example by which the bulk dispenser 100 can be configured to rotate in predetermined increments, such as multiples of a quarter turn. A top end of the container body 102 can be provided with a plurality of ribs 170 based on the number of predetermined rotation increments. For example, the container body 102 can include 4 ribs which cause the actuator 106 to rotate in multiples of a quarter turn. The actuator 106 can include a follower 172 that rides each rib 170 as the actuator is rotated from an initial position to a final position. The actuator 106 can be biased (not shown) such that if the actuator 106 is not rotated completely between the initial position and the final position, the actuator 106 moves back into its starting position prior to the start of rotation. The actuating member 110 can be provided with a sufficient degree of freedom to allow for movement of the follower 172 over each of the ribs 170 as the actuator 106 is turned.

To dispense multiple unit doses, such as for treating a medium, large, and extra-large load, the actuator 106 can be rotated to bring additional openings 138, 136, and 134 into alignment with the outlet 150 to dispense two, three, or four unit doses, respectively. In this example, a quarter turn of the actuator 106 dispenses a single unit dose suitable for a small load, a half turn of the actuator 106 dispenses two unit doses suitable for a medium load, a three-quarter turn dispenses three unit doses for a large load, and a full turn of the actuator 106 dispenses four unit doses suitable for an extra-large load.

If the bulk dispenser is to be manually operated, the bulk dispenser 100 can optionally be provided with indicia that indicates to a user the degree to which the actuator 106 is to be rotated to dispense a predetermined amount of treating chemistry. The indicia may include text, graphics, coloring, and/or 3-dimensional features to provide information to a user regarding how to manually operate the bulk dispenser 100 to dispense a desired predetermined amount of chemistry. The indicia may be located on a single component, such as the actuator 106, or located on multiple components, non-limiting examples of which include the actuator 106, the container body 102, the hollow column 99, the user interface 98, and the cabinet 12.

For example, an upper surface of the actuator 106 can include indicia indicating a degree of rotation of the actuator 106 in a predetermined increment, such as a quarter turn increment. Optionally, the bulk dispenser 100 includes indicia indicating when the dispensing outlet 130 is closed. For example, indicia disposed on the actuator 106 can be configured to align with indicia on the container body 102 and/or the clothes mover 20 that is visible to the user when the first and second plates 120, 122 are aligned such that the dispensing outlet 130 is closed.

The container body 102 can be configured to hold a desired number of unit doses and is refillable such that multiple unit doses may be dispensed during one or more cycles of operation. The bulk dispenser 100 can be configured such that it is removable from the hollow column 99 of the clothes mover 20 to refill and/or clean the reservoir 104. In some aspects of the present disclosure, the bulk dispenser 100 is not removable from the clothes mover 20. In these aspects, the actuator 106 may be removable to provide access to the reservoir 104 for refilling and/or cleaning. Optionally, the actuator 106 and/or the container body 102 includes a port configured to allow a user to refill and/or clean the reservoir 104.

While the actuator 106 is described as being rotatable to dispense a treating chemistry, in some aspects, the actuator 106 may be coupled with the first plate 120 such that vertical movement of the actuator 106 by a user, such as depressing or withdrawing the actuator 106, moves the first plate 120 relative to the second plate 122 to dispense a treating chemistry. In some aspects, the actuator 106 is configured to be depressed to disengage the current seal 140-146 from the outlet 150 prior to rotating the actuator 106 to rotate the first plate 120. When the user releases the actuator 106 after dispensing the treating chemistry, a biasing element (not shown) may be provided to bias the first plate 120 toward the second plate 122 to facilitate forming the liquid-seal between the aligned seal 140-146 and the outlet 150.

Figure 4:
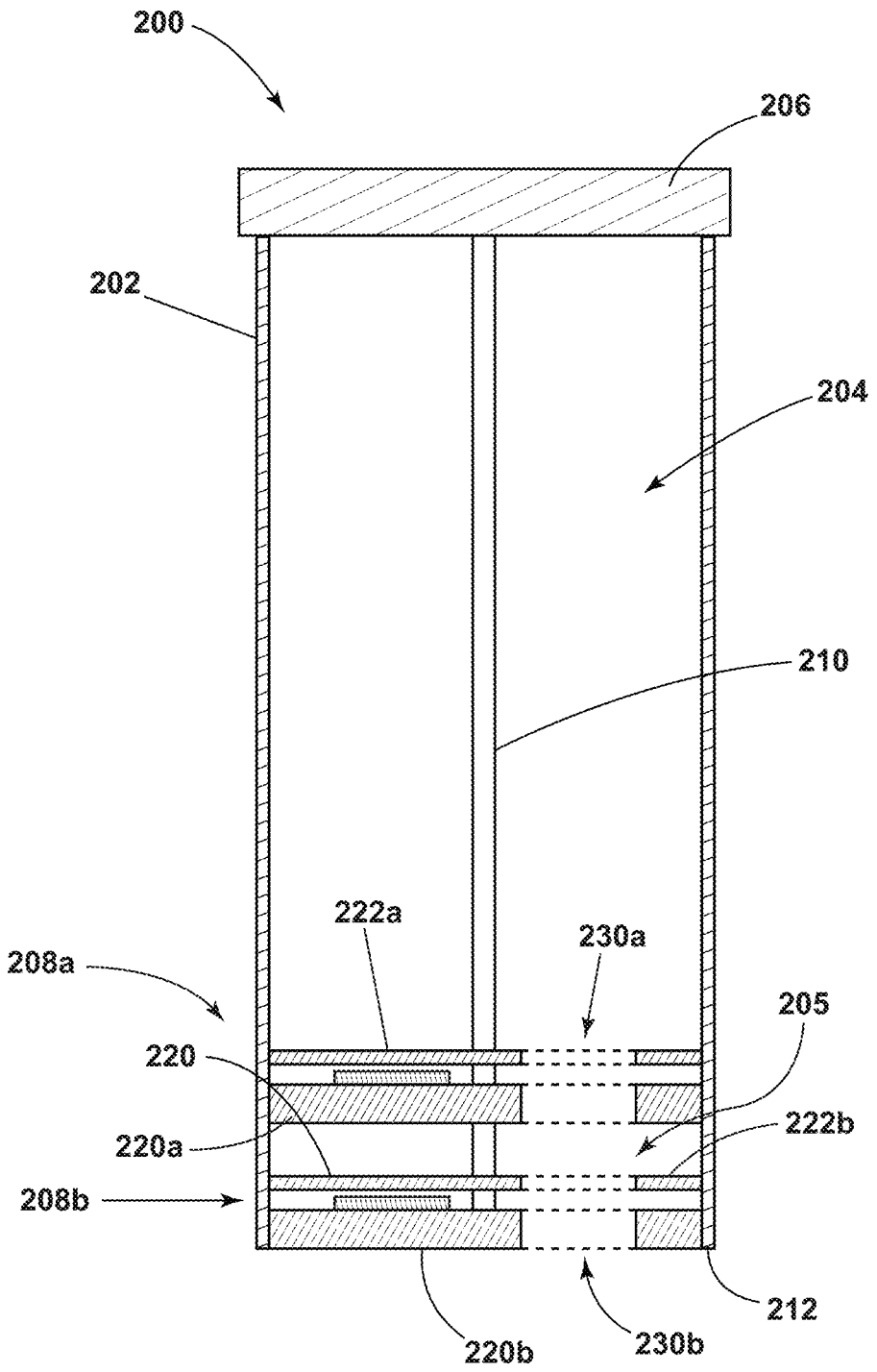
FIG. 4 is a schematic cross-sectional view of a bulk dispenser for use in the laundry treating appliance of FIG. 1 according to the present disclosure.

FIG. 4 illustrates another embodiment of a bulk dispenser 200 that has similarities with the bulk dispenser 100 of FIG. 2A. Therefore, elements of the bulk dispenser 200 that are similar to the bulk dispenser 100 are labeled with similar part numbers using the prefix 200. The bulk dispenser 200 can be used with the washing machine 10 to dispense a treating chemistry to the treating chamber 18 for use in treating the laundry according to a cycle of operation.

The bulk dispenser 200 includes a first dispenser assembly 208*a* and a second dispenser assembly 208*b* that are operably coupled with the actuator 206 to selectively supply a treating chemistry to the treating chamber 18. The first dispenser assembly 208*a* controls dispensing of the treating chemistry from the reservoir 204 to an intermediate reservoir 205. Dispensing of the treating chemistry from the intermediate reservoir 205 is controlled by the second dispenser assembly 208*b*. The intermediate reservoir 205 can inhibit or slow moisture from entering the reservoir 204, which can result in aggregation and/or degradation of the treating chemistry stored within the reservoir 204.

Each of the first and second dispenser assemblies 208*a* and 208*b* can include a first plate 220*a* and 220*b* that is moveable relative to a second plate 222*a* and 222*b* through the actuator 206 in a manner similar to that described above for the dispenser assembly 108 of FIG. 2A. The first and second plates 220*a*, 222*a* of the first dispenser assembly 208*a* cooperate to selectively form a first dispensing outlet 230*a* to supply treating chemistry from the reservoir 204 to the intermediate reservoir 205. The first and second plates 220*b*, 222*b* of the second dispenser assembly 208*b* cooperate to selectively form a second dispensing outlet 230*b* to dispense treating chemistry from the intermediate reservoir 205 to the treating chamber 18. The intermediate reservoir 205 may be configured to limit the amount of treating chemistry dispensed for every quarter turn to define a single unit dose.

Figure 5:
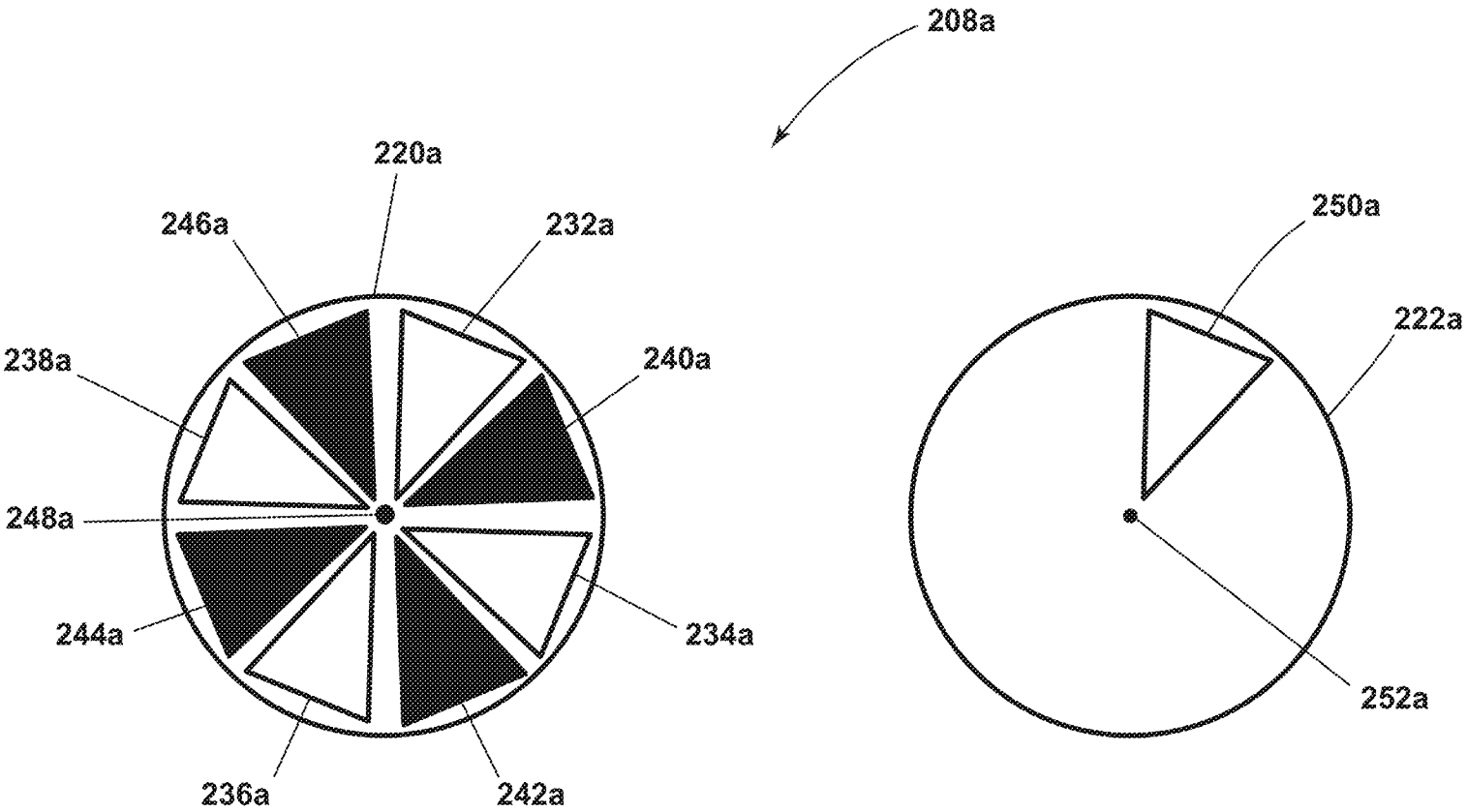
FIG. 5 is a top down view of a first dispensing assembly for use in the bulk dispenser of FIG. 4 according to the present disclosure.

Referring now to FIG. 5, the first dispenser assembly 208*a* includes a first plate 220*a* having a plurality of openings 232*a*-238*a* spaced around the first plate 220*a*. The openings 232*a*-238*a* may be the same or different size and may be evenly or unevenly spaced around the first plate 220*a* based on the amount of treating chemistry to be dispensed. Optionally, portions of the first plate 220*a* between the openings 232*a*-238*a* include a seal 240*a*-246*a*. The first plate 220*a* is coupled to the actuating member 210 at a central axis 248*a* thereof for co-rotation about the central axis 248*a* when the actuator 206 is rotated. The second plate 222*a* is stationary with respect to the first plate 220*a* and includes an outlet 250*a*. The outlet 250*a* cooperates with the openings 232*a*-238*a* in the first plate 220*a* to form the first dispensing outlet 230*a* for dispensing the treating chemistry from the reservoir 204 to the intermediate reservoir 205.

Figure 6:
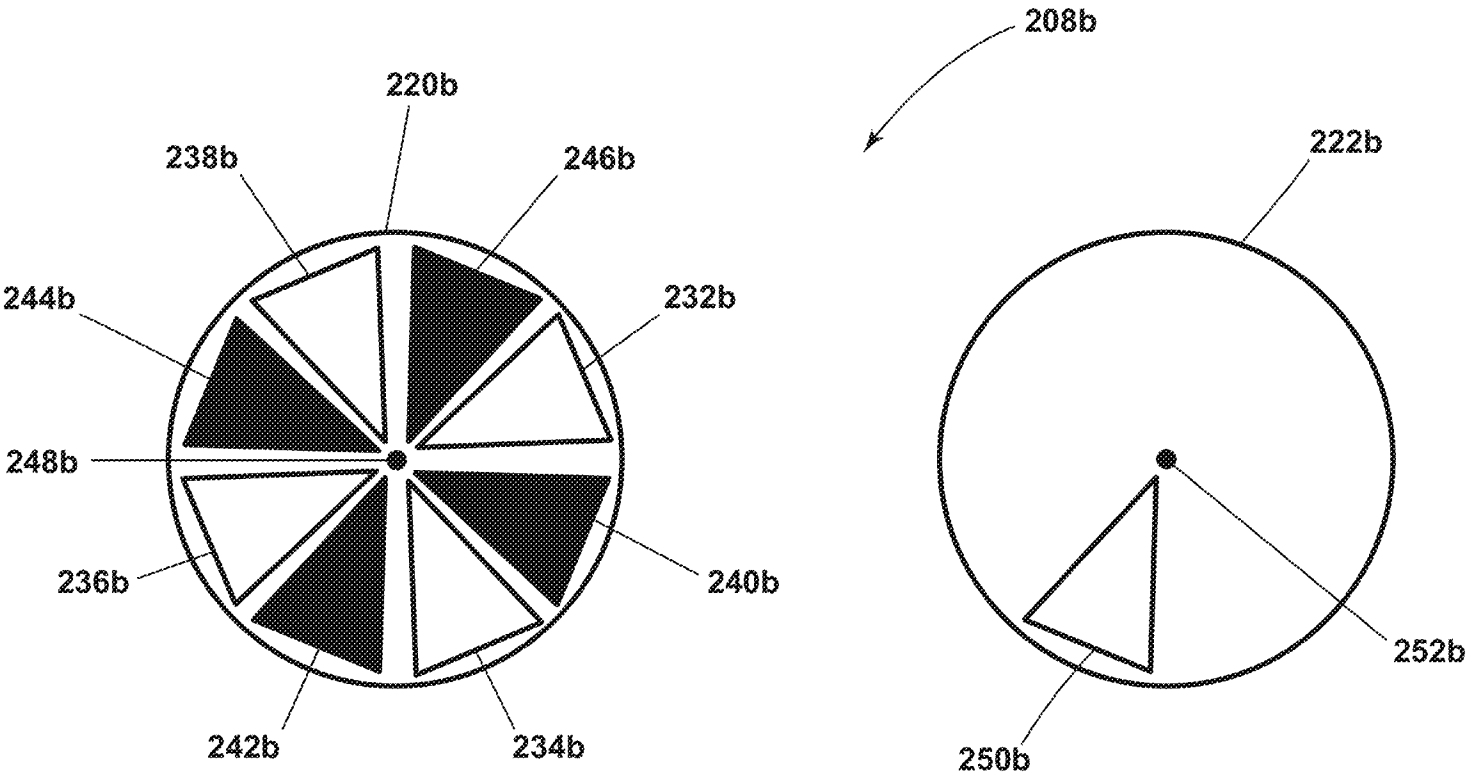
FIG. 6 is a top down view of a second dispensing assembly for use in the bulk dispenser of FIG. 4 according to the present disclosure.

Referring now to FIG. 6, the second dispenser assembly 208*b* includes a first plate 220*b* having a plurality of openings 232*b*-238*b* spaced around the first plate 220*b*. The openings 232*b*-238*b* may be the same or different size and may be evenly or unevenly spaced around the first plate 220*b* based on the amount of treating chemistry to be dispensed. Optionally, portions of the first plate 220*b* between the openings 232*b*-238*b* include a seals 240*b*-246*b*. The first plate 220*b* is coupled to the actuating member 210 at a central axis 248*b* thereof for co-rotation about the central axis 248*b* when the actuator 206 is rotated. The second plate 222*b* is stationary with respect to the first plate 220*b* and includes an outlet 250*b*. The outlet 250*b* cooperates with the openings 232*b*-238*b* in the first plate 220*b* to form the second dispensing outlet 230*b* for dispensing the treating chemistry from the intermediate reservoir 205 to the treating chamber 18.

In the embodiment of FIGS. 2 and 3, the size of the dose dispensed is based on the manner in which the actuator 106 is rotated. If the actuator 106 is rotated quickly, a smaller dose of treating chemistry is dispensed than when the actuator 106 is rotated slowly. If rotation of the actuator 106 is stopped when one of the openings 132-138 is aligned with the outlet 150, the entire amount of treating chemistry stored in the reservoir 104 would be dispensed. In the embodiment of FIGS. 4-6, the variability in the size of the dose based on the speed at which the actuator is rotated 206 is addressed. The intermediate reservoir 205 limits the size of the dose dispensed each time the second dispensing outlet 230*b* is open.

Referring again to FIG. 4, in operation, the actuator 206 can be rotated so the first plate 220*a* rotates relative to the second plate 222*a* of the first dispenser assembly 208*a* to selectively dispense treating chemistry stored in the reservoir 204 into the intermediate reservoir 205. The dimensions, spacing, and position of the openings 232*a*-238*a* in the first plate 220*a* and the outlet 250*a* in the second plate 222*a* are configured to dispense a predetermined amount of treating chemistry based on the operation of the actuator 206. When the first plate 220*a* is rotated such that an opening 232*a*-238*a* is aligned with the outlet 250*a* in the second plate 222*a*, the first dispensing outlet 230*a* is opened and treating chemistry is dispensed from the reservoir 204 through the first dispensing outlet 230*a* to the intermediate reservoir 205. The intermediate reservoir 205 can be configured to hold one or more unit doses dispensed through the first dispensing outlet 230*a*.

Rotation of the actuator 206 also causes the first plate 220*b* of the second dispenser assembly 208*b* to selectively dispense treating chemistry from the intermediate reservoir 205. The first plates 220*a* and 220*b* cooperative to first dispense treating chemistry from the reservoir 204 into the intermediate reservoir 205 and then to dispense the treating chemistry in the intermediate reservoir 205 into the treating chamber 18. When the first plate 220*b* is rotated such that an opening 232*b*-238*b* is aligned with the outlet 250*b* in the second plate 222*b*, the second dispensing outlet 230*b* is opened and treating chemistry is dispensed from the intermediate reservoir 205 through the second dispensing outlet 230*b* to the treating chamber.

In the example illustrated in FIGS. 5 and 6, the first and second dispenser assemblies 208*a, b* are configured such that the first and second dispensing outlet 230*a* and 230*b* are not open at the same time. For example, the relative position of the outlet 250*a* in the first dispenser assembly 208*a* and the outlet 250*b* in the second dispenser assembly 208*b* can be offset such that each time the intermediate reservoir 205 is filled with a single unit dose of treating chemistry, the single unit dose in the intermediate reservoir 205 is dispensed through the second dispensing outlet 230*b* before the next unit dose is dispensed into the intermediate reservoir 205. As shown in the embodiment of FIGS. 5 and 6, every ⅛ turn of the actuator 206 will open one of the first and second dispensing outlet 230*a* and 230*b* and close the other of the first and second dispensing outlet 230*a* and 230*b*. Alternatively, the first and second dispenser assemblies 208*a, b* may be configured such that the first and second dispensing outlets 230*a* and 230*b* are open, or partially opened, at the same time.

Table 1 below illustrates how the exemplary first and second dispenser assemblies 208*a* and 208*b* can be utilized to dispense one or more unit doses for treating loads of different sizes. It will be understood that elements of the first and second dispenser assemblies 208*a* and 208*b*, non-limiting examples of which include the dimensions, shape, spacing, and relative position of the openings, can be set based on the desired amount of treating chemistry to be dispensed. The information in Table 1 is based on the positions of the first and second plates 220*a*, 220*b* and 222*a*, 222*b* as shown in FIGS. 5 and 6 corresponding to the "Initial Position." Subsequent positions are based on a degree of rotation clockwise from the Initial Position shown in FIGS. 5 and 6. When the first plate 220*a* is "open," treating chemistry is dispensed from the reservoir 204 into the intermediate reservoir 205. When the first plate 220*b* is "open," treating chemistry is dispensed from the intermediate reservoir 205 into the treating chamber 18.

TABLE 1

Treating Chemistry Dispensing Based on Rotation

| | Initial Position | 45° | 90° | 135° | 180° | 225° | 270° | 315° |
|---|---|---|---|---|---|---|---|---|
| Plate 220a | 232a Open | Closed | 234a Open | Closed | 236a Open | Closed | 238a Open | Closed |
| Plate 220b | Closed | 232b Open | Closed | 234b Open | Closed | 236b Open | Closed | 238b Open |
| Load Size | | Small | | Medium | | Large | | X-Large |

Each 45 degree rotation of the actuator 206 causes a single unit dose to either be dispensed from the reservoir 204 into the intermediate reservoir 205 or dispensed from the intermediate reservoir 205 into the treating chamber 18. Every 90 degrees of rotation of the actuator 206 results in a unit dose being dispensed into the treating chamber 18. For example, for a "medium" load size, two unit doses have been dispensed. The first unit dose was dispensed when the actuator 206 was rotated 45 degrees and a second unit dose was dispensed when the actuator 206 continued to rotate to 135 degrees. The embodiments of FIGS. 5 and 6 provide can be utilized to dispense four different dosing amounts from the bulk dispenser 200.

If intended for manual use by a user, the bulk dispenser 200 and/or additional components of the washing machine 10 are optionally provided with indicia that indicates to a user the degree to which the actuator 206 is to be rotated to dispense a predetermined amount of treating chemistry. The indicia may include text, graphics, coloring, and/or 3-dimensional features to provide information to a user regarding how to operate the bulk dispenser 200 to dispense a desired predetermined amount of chemistry. The indicia may be located on a single component, such as the actuator 206, or located on multiple components, non-limiting examples of which include the actuator 206, the container body 102, the hollow column 99, the user interface 98, and the cabinet 12. For example, an upper surface of the actuator 206 can include indicia indicating a degree of rotation of the actuator 206 in a predetermined increment, such as a 45 degree turn.

Figure 7:
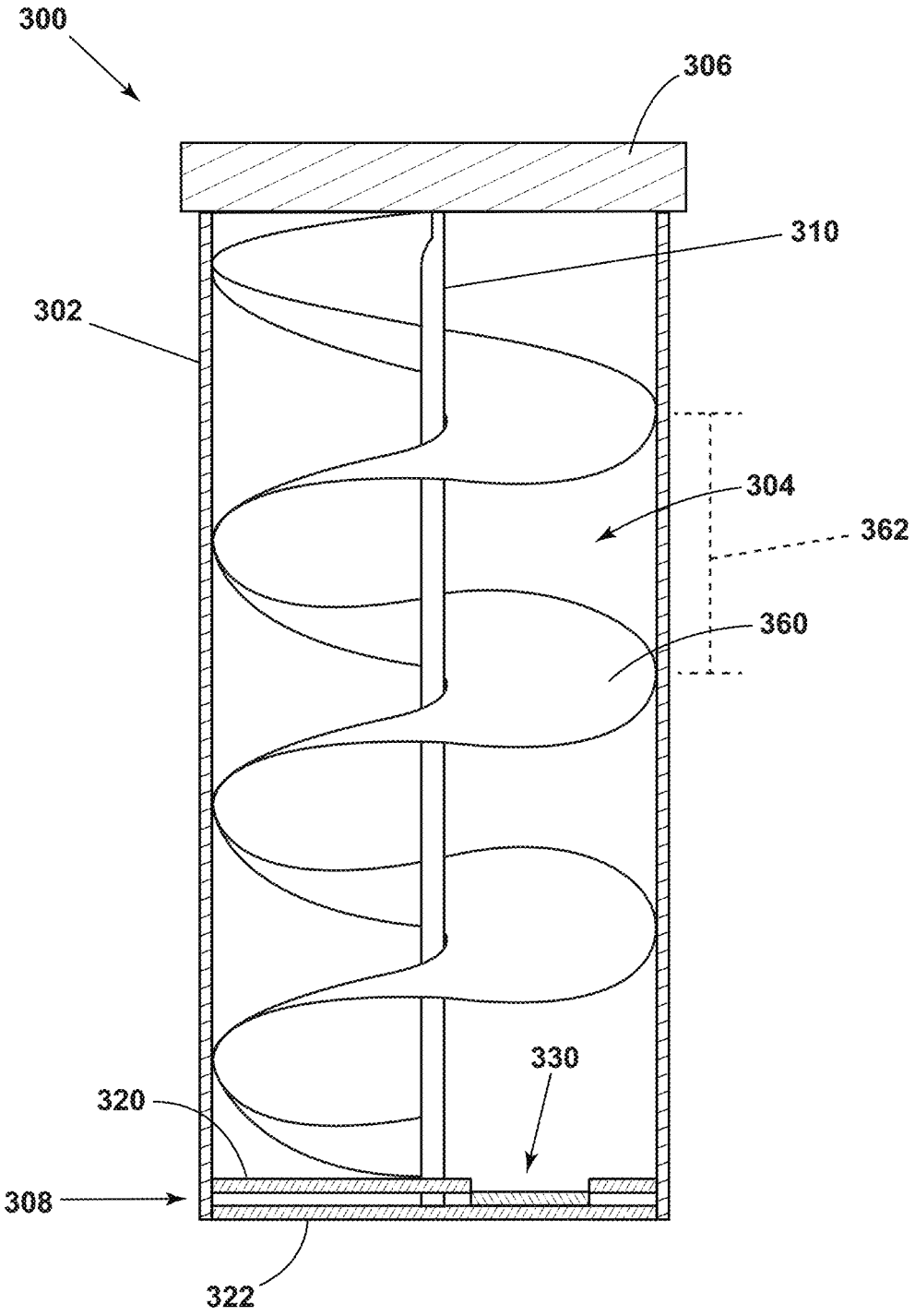
FIG. 7 is a schematic cross-sectional view of a bulk dispenser for use in the laundry treating appliance of FIG. 1 according to the present disclosure.

FIG. 7 illustrates another embodiment of a bulk dispenser 300 similar to the bulk dispenser 100 of FIG. 2A, with some differences. For example, the bulk dispenser 300 utilizes a screw conveyor 360, also referred to as a worm screw, to dispense a predetermined amount of treating chemistry.

Therefore, elements of the bulk dispenser 300 that are similar to the bulk dispenser 100 are labeled with similar part numbers using the prefix 300. The bulk dispenser 300 can be used with the washing machine 10 to dispense a treating chemistry to the treating chamber 18 for use in treating the laundry according to a cycle of operation.

The screw conveyor 360 is in the form of a helical screw blade or auger that is coupled with the actuator 306 through the actuating member 310 for rotation within the container body 302. The screw conveyor 360 can include a flight 362, also referred to as a pitch, corresponding to a single unit dose. Rotation of the actuator 306 causes the screw conveyor 360 to rotate, transporting material through the length of the container body 302 toward the dispensing outlet 330. The dispenser assembly 308 can include first and second plates 320 and 322 that are configured to rotate with the actuator 306 to selectively open and close the dispensing outlet 330 to dispense the treating chemistry from the reservoir 304.

Figure 8:
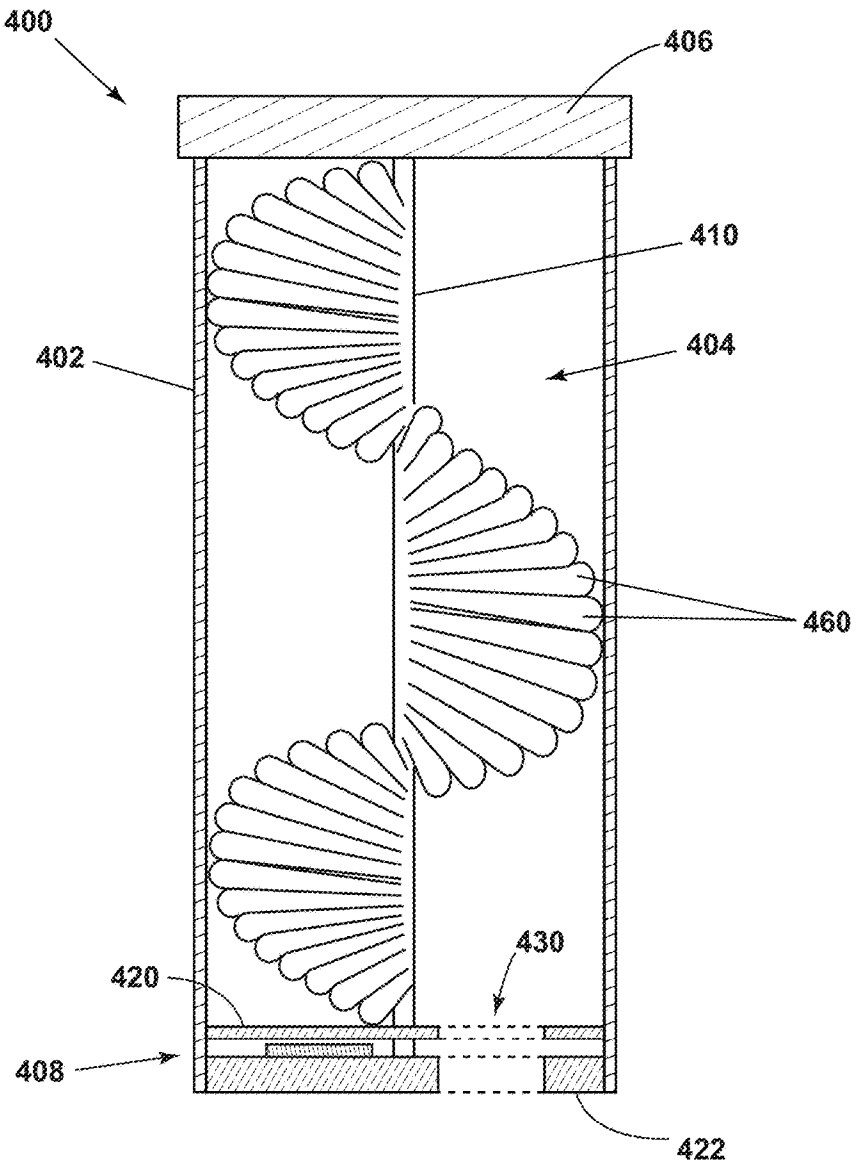
FIG. 8 is a schematic cross-sectional view of a bulk dispenser for use in the laundry treating appliance of FIG. 1 according to the present disclosure.

FIG. 8 illustrates another embodiment of a bulk dispenser 400 similar to the bulk dispenser 100 of FIG. 2A, with some differences. For example, the bulk dispenser 400 includes a plurality of projections 460 extending from the actuating member 410. Therefore, elements of the bulk dispenser 400 that are similar to the bulk dispenser 100 are labeled with similar part numbers using the prefix 400. The bulk dispenser 400 can be used with the washing machine 10 to dispense a treating chemistry to the treating chamber 18 for use in treating the laundry according to a cycle of operation in the same manner as described above regarding the bulk dispenser 100 of FIG. 2A. The projections 460 are configured to engage an interior surface of the container body 402 as the actuator 406 is rotated to dislodge or break-up treating chemistry that may have agglomerated within the container body 402 or adhered to the interior surface of the container body 402. The projections 460 may have any suitable design and be made from any suitable natural or synthetic material for dislodging and breaking-up treating chemistry, non-limiting examples of which include bristles, fingers, and blades, and which may be rigid or flexible.

The treating chamber 18 is a moist environment and thus some moisture may enter the reservoir 404. Moisture in the reservoir 404 may cause the treating chemistry to form clumps and/or adhere to the interior surface of the container body 402. Aggregation of the treating chemistry can generate clumps that may clog the dispensing outlet 430 or interfere with operation of the actuator 406 and actuating member 410. The projections 460 are coupled to the actuating member 410 and thus are rotated whenever the actuator 406 is operated to dispense a treating chemistry, which may decrease the likelihood of formation of undesirable clumps in the treating chemistry. The projections 460 may also be used in a similar manner with the bulk dispenser 200 of FIG. 4 to decrease the likelihood of the formation of undesirable aggregation.

To the extent not already described, the different features and structures of the various aspects of the present disclosure may be used in combination with each other as desired. That one feature may not be illustrated in all of the aspects of the present disclosure is not meant to be construed that it cannot be, but is done for brevity of description. Thus, the various features of the different aspects of the present disclosure may be mixed and matched as desired to form new embodiments, whether or not the new embodiments are expressly described. For example, components of the bulk dispensers 100, 200, 300, and 400 can be combined in various combinations to form additional examples of bulk dispenser without deviating from the scope of the present disclosure.

While the present disclosure has been specifically described in connection with certain specific embodiments thereof, it is to be understood that this is by way of illustration and not of limitation. Reasonable variation and modification are possible within the scope of the forgoing disclosure and drawings without departing from the spirit of the present disclosure which is defined in the appended claims.

What is claimed is:

1. A laundry treating appliance comprising:

a treating chamber;

an agitator rotatably mounted in the treating chamber and having a skirt and a hollow shaft extending upwardly from the skirt; and a bulk dispenser located within the hollow shaft comprising a tubular tank with a rotatable actuator on a first end, a dispenser assembly on a second end, and a shaft passing through the tubular tank and connecting the rotatable actuator to the dispenser assembly;

the dispenser assembly comprising first and second dispenser plates positioned on the second end of the tubular tank, one of the first and second plates comprising at least one opening and at least one seal, the other of the first and second plates comprising an outlet having a shape complimentary to the at least one seal, the at least one seal comprising a raised portion that is configured to be received in the outlet on the other of the first and second plates;

a plurality of projections extending from the shaft for moving a treating chemistry through the hollow shaft;

wherein rotating of the actuator effects a rotation of the plurality of projections, which effects dispensing a predetermined amount of the treating chemistry from the outlet.

2. The laundry treating appliance of claim 1, wherein the plurality of projections engage an interior surface of the tubular tank.

3. The laundry treating appliance of claim 1, wherein the plurality of projections are positioned along a length of the shaft.

4. The laundry treating appliance of claim 1, wherein the at least one seal is liquid-tight.

5. The laundry treating appliance of claim 1, wherein the at least one opening comprises a plurality of openings and the at least one seal comprises a plurality of seals.

6. The laundry treating appliance of claim 5, wherein the plurality of openings and the plurality of seals are alternately positioned about one of the first and second plates.

7. The laundry treating appliance of claim 1, wherein the first plate moves relative to the second plate.

8. The laundry treating appliance of claim 1, wherein the plurality of projections comprise one of bristles, fingers, and blades.

9. The laundry treating appliance of claim 1, wherein the plurality of projections are rigid.

10. The laundry treating appliance of claim 1, wherein the plurality of projections are flexible.

11. The laundry treating appliance of claim 7, wherein the first plate is coupled to the actuator.

12. The laundry treating appliance of claim 1, wherein the bulk dispenser is actuated by a motor in communication with the actuator.

13. The laundry treating appliance of claim 1, wherein the at least one seal comprises one of a rubber and polymeric material.

* * * * *